US005936241A

United States Patent [19]

Franzen et al.

[11] Patent Number: 5,936,241

[45] Date of Patent: Aug. 10, 1999

[54] METHOD FOR SPACE-CHARGE CONTROL OF DAUGHTER IONS IN ION TRAPS

[75] Inventors: Jochen Franzen; Michael Schubert, both of Bremen, Germany

[73] Assignee: Bruker Daltonik GmbH, Bremen 33, Germany

[21] Appl. No.: 09/032,579

[22] Filed: Feb. 27, 1998

[30] Foreign Application Priority Data

Mar. 6, 1997 [DE] Germany ..... 197 09 086

[51] Int. Cl.[6] ..... H01J 49/42

[52] U.S. Cl. ..... 250/282

[58] Field of Search ..... 250/282, 281, 250/286, 290, 292

[56] References Cited

U.S. PATENT DOCUMENTS 5,083,019 1/1992 Spangler ..... 250/286
5,420,423 5/1995 Linden ..... 250/290
5,422,482 6/1995 Nakajima et al. ..... 250/290

FOREIGN PATENT DOCUMENTS 0630042 12/1994 European Pat. Off. .
2280781 2/1995 United Kingdom .
9519041 7/1995 WIPO .

*Primary Examiner*—Kiet T. Nguyen

[57] ABSTRACT

The invention consists of deriving the control of the space charge in the ion trap for the initial daughter ion spectrum from the filling rates of previous normal spectra, from the abundance ratio of the parent ions to be isolated to the total ions in the spectrum, and from the at least roughly known isolation and fragmentation yields. For further daughter ion spectra, the resulting measured overall filling rate with daughter ions may be used. The same applies in an analogue way to spectra of isolated ions or of ions from $MS^n$ processes.

9 Claims, 1 Drawing Sheet

$f_4$ $f_3$ $f_2$ $f_1$ $$a_3 = f_3 - f_4 \qquad a_2 = f_2 - f_3 \qquad a_1 = f_1 - f_2$$

$$b_2 = a_2 - a_3 \qquad b_1 = a_1 - a_2$$

$$c_1 = b_1 - b_2$$

$$f_{0.lin} = f_1 + a_1$$

$$f_{0.qu} = f_1 + a_1 + b_1$$

$$f_{0.cu} = f_1 + a_1 + b_1 + c_1$$

$$f_d = f_0 \times i_p \times a_p \times a_f / i_{tot}$$

$f_4$ $f_3$ $f_2$ $f_1$ $a_3 = f_3 - f_4$ $a_2 = f_2 - f_3$ $a_1 = f_1 - f_2$ $b_2 = a_2 - a_3$ $b_1 = a_1 - a_2$ $c_1 = b_1 - b_2$ $$f_{0.lin} = f_1 + a_1$$

$$f_{0.qu} = f_1 + a_1 + b_1$$

$$f_{0.cu} = f_1 + a_1 + b_1 + c_1$$

$$f_d = f_0 \times i_p \times a_p \times a_f / i_{tot}$$

Figure 1

METHOD FOR SPACE-CHARGE CONTROL OF DAUGHTER IONS IN ION TRAPS

The invention relates to the control of the space charge inside the ion trap at the begin of a daughter ion spectrum acquisition in an ion trap mass spectrometer, when this spectrum is embedded in a series of normal spectra. It relates analagously to space charge control for the acquisition of an imbedded spectrum of an isolated ion species or of granddaughter ions.

The invention consists of deriving the control of the space charge in the ion trap for the first daughter ion spectrum from the filling rates of previously acquired normal spectra, from the abundance ratio of the parent ions to be isolated to the total ions in the spectrum, and from the at least roughly known isolation and fragmentation yields. For further daughter ion spectra, the resulting measured overall filling rate with daughter ions may be used. The same applies in an analogous way to spectra of isolated ions or of ions from $MS^n$ processes.

PRIOR ART

Paul ion traps consist of an RF-supplied ring electrode and two, usually perforated, end cap electrodes; ions can be stored inside this structure. The ion trap may be used as a mass spectrometer by ejecting the stored ions in a mass-selective way through the perforations in one of the end caps and measuring them outside the structure using secondary-electron multipliers. Several different methods are known for mass-selective ion ejection which will not be described here in detail.

Only relatively few ions should be stored in high performance ion trap spectrometers at the beginning of a mass scan, if well resolved spectra with a correct mass assignment are to be obtained. If there are too many ions in the ion trap, the space-charge of the ions disturbs ion ejection and consequently the spectrum scan. Thus, for a widely distributed commercial mass spectrometer of this type, reports have told of only 300 utilizable ions available for the measurement of an individual spectrum. In ion traps used by the applicant company, approximately 2,000 ions are available for an individual spectrum. Even with this, however, the dynamic range within a spectrum is extremely limited.

Ion trap mass spectrometers have, on the other hand, properties which make their use attractive for many types of analyses. Thus selected species of ions with common mass (so-called "parent ions") may be isolated and fragmented in the ion trap. The spectra of these fragment ions are known as "daughter ion spectra" of the relevant parent ions. "Granddaughter ion spectra" may also be measured as fragment ion spectra of selected daughter ions.

The space-charge limit may be determined from the drift of the ion signals or by an increase of their widths during spectrum acquisition by ion ejection. A standard definition relates to a drift of 0.1 atomic mass units, meaning that the space charge limit is defined as the ion quantity in the ion trap which effects a delay in the ejection of ions by a difference in time that, when converted to mass, corresponds to a mass drift of 0.1 atomic mass units from normal conditions.

Inception of the space-charge effect is relatively clear-cut. An increase of only 10% in the filling quantity at the space-charge limit already causes another drift by about 0.1 atomic mass units, whereas if one remains about 20% below the space-charge limit, the mass drift is no longer measurable.

The optimal filling quantity must always remain a safe distance below the filling quantity at the space-charge limit. The size of safety margin to be selected depends upon the quality of the space-charge control. A very good control allows work at an optimal filling that is only 20% below the space-charge limit. A control which is less good may necessitate work at half or even at a third of the space-charge limit. Therefore, the quality of the control has a strong influence on the dynamic range of measurement in the spectrum.

Particularly when coupling the ion trap mass spectrometer with chromatographic or electrophoretic separation methods, the available substance concentrations change quite dramatically. For the above-named reasons, adjustment of the ion trap to changing substance concentrations or to changing ionization, reaction or decomposition conditions, has to be actively undertaken because it cannot be compensated for by the dynamic range in the mass spectrum, such as is possible for magnetic sector field or quadrupole mass spectrometers. These have a dynamic range of measurement from 6 to 9 orders of magnitude for the measurement of the ion currents of a spectrum.

Therefore, the dynamic range of measurement in the ion trap must be adjusted to the concentration by the conditions for the control of optimal filling of the ion trap with ions. If, for example, the concentration of a substance in the sample is high, the filling time for the ion trap until the optimal amount of ions has been reached is only brief. If on the other hand the concentration is very low, a long time is required in order to fill the ion trap optimally. To fill the trap with reaction products or daughter ions, a control similar to this may be performed.

The filling times may, in practice, be varied between 10 microseconds and 100 milliseconds (in cases of slowly changing concentrations, even up to one second), i.e. over a range of four to five orders of magnitude. If this method is applied to quantitative analysis, the concentration is then determined from a value which—at constant generation of ions—is calculated as the signal height in the spectrum divided by the filling time. This value is proportional to the ion current of this ion species which is generated during ionization. In this way, by application of this calculated value for the ion current, the determination of concentration is comparable with that by other types of mass spectrometers. The dynamic range of concentration measurements for ion trap mass spectrometers thereby increases from meager 3 to acceptable 7 or 8 orders of magnitude; this only applies however if there is no disturbing surplus of other ions in the ion trap.

The control for filling the ion trap must be based upon a measurement of the ion number in the ion trap, from which a control value for the filling may then be calculated. Since there is not a simple enough method for nondestructive measurement of ions in the ion trap, two different methods have been developed:

(1) The "prescan" method, for which a brief filling process with a constant filling time is placed upstream of the actual scan. The ions thus formed are expelled from the trap and measured. The optimal filling time is determined from this measurement value (U.S. Pat. No. 5,107,109). An improvement of this is in not keeping the filling time of the prescan constant, but to instead control the filling time of the prescan from preceding measurements toward optimal measuring conditions (U.S. Pat. No. 5,448,061). Both of these methods require additional measuring time for the prescan which is lost for the actual scan.

(2) Another method uses a filling control which is based on the known filling rate of one or even several preceding spectra (U.S. Pat. No. 5,559,325). From these filling rates of previous spectra, an expected value is extrapolated for the current filling rate. The extrapolation may be linear, quadratic, cubic, exponential or based on any other known function, according to conditions. The forecast value is used to achieve the optimal filling quantity. The filling rate is defined here as the filling quantity divided by the known filling time, the filling quantity being determined as an integrated ion current over a full spectrum. Since the previously measured analytical spectra are used here, no additional time for a prescan s wasted. This type of space-charge control is a great improvement over the prescan method, especially for condition where drastic changes in the concentration of the substances occur, such as in chromatographic separation methods.

Ion trap mass spectrometers are frequently used as mass-specific detectors for chromatography or capillary electrophoresis. A common type of ionization here is the electrospray ionization (ESI) method, which ionizes ions at atmospheric pressure. These ions are then introduced via known inlet systems into the vacuum of the mass spectrometer and from there into the ion traps. Similarly, chemical ionization using reactant gas ions at atmospheric pressure may also be used (APCI=atmospheric pressure chemical ionization).

These types of ionization generate practically no fragment ions; the ions are in the main those of the molecule. However, entire series of multiply charged ions from the molecules do appear. Since there are no fragment ions, information from the mass spectrum is limited to the molecular weight; information regarding internal molecular structures, which could be used for further identification of the present substance, is not available. Therefore, the spectra are not at all comparable with those from electron impact ion sources.

In order to make the spectra as informative as those obtained using a GC/MS method with electron impact ionization, it is necessary to suitably generate fragment ion spectra. This may be done by automatically scanning daughter ion spectra.

The automatic scanning of daughter ion spectra is not a minor matter however, since the parent ions from which the daughter ions must be generated are not known from the start. Thus for this purpose, normal mass spectra sequentially scanned from the coupling of the ion trap with the chromatograph or electrophoresis unit must be continuously investigated by a computation program. If a substance appears in a chromatogram or electropherogram, a suitable ion type must automatically be selected and a daughter ion scan prepared. A suitable control procedure for the space charge is now sought for this daughter ion scan.

To select the parent ions, the largest mass peak of the spectrum may be selected, for example. If the molecular weights of the substances being analyzed are not too great, it has become evident that it is better to use doubly charged ions which provide very good structural information. The doubly charged ions can be recognized from the interval of the peaks in the isotope group which is exactly ½ atomic mass unit.

For the control of the space charge when scanning the daughter ion spectrum, only the prescan method has been known until now. To do this, however, it is necessary to also isolate and fragment the ions within a prescribed time after sample filling of the ion trap in order to then measure through rapid ejection the number of daughter ions formed. However, this procedure requires almost as much time as subsequent scanning of the daughter ion spectrum. Thus the method is very unsatisfactory.

Especially when coupled with chromatographic or electrophoretic separation methods, the substances from which daughter or granddaughter ion spectra (or those from isolated ions) are to be measured automatically are only available for a few seconds and the concentration changes very quickly. For this reason, the control of the space charge, important for good spectra, becomes a serious problem.

OBJECTIVE OF THE INVENTION

It is the objective of the invention to find methods to control, in ion trap mass spectrometer, the daughter ion quantity inside the trap for daughter ion spectra (or, respectively, the ion quantity of isolated ions or of granddaughter ions for corresponding spectra), under conditions where such spectra are acquired embedded in a series of normal spectra. In particular, a method is sought which can be used if no previous daughter ion spectrum of this parent ion spesies has yet been scanned. The method should use the substance sparingly and work well even under the difficult conditions of a rapidly changing concentration.

DESCRIPTION OF THE INVENTION

The mass spectra of nonisolated and nonfragmented ions will be described henceforth as "normal spectra", in contrast to "isolated ion spectra" which consist solely of isolated, though nonfragmented ions, and the above defined "daughter ion spectra". However, for the measurement of "granddaughter ion spectra", a previously measured series of daughter ion spectra may be regarded as "normal spectra".

It is now the basic idea of the invention to use the filling rates of the last previously scanned normal spectra for control of the space charge of the first daughter ion spectrum, and to calculate from this (as for example in U.S. Pat. No. 5,559,325) a forecast value of the filling rate $f_0$ of the next normal spectrum and, for the forecast value of the filling rate $f_d$ of the daughter ions, to additionally take into account the ratio $i_p/i_{tot}$ of the known abundance $i_p$ of the parent ions from the last spectrum to the integral ion current of the total spectrum $i_{tot}$, the yield $a_p$ from the isolation of these parent ions and the yield $a_f$ from the fragmentation into daughter ions:

$$f_d = f_0 \times i_p \times a_p \times a_f / i_{tot}. \quad (1)$$

The yields of the individual processes are generally well enough known already. However, they may also be calibrated by using similar analyte substances.

In an anlogous way, the first granddaughter ion spectrum may be taken with space charge control derived by a series from previously acquired daughter ion spectra.

From this forecast filling rate $f_d$ for daughter ions, an optimal filling time is then calculated for a prescribed, optimal quantity of ions which is then used to control the filling (and ion manipulation) procedure for the first daughter ion spectrum.

During some phases of the sequential processes of ion generation, storage, isolation and fragmentation, the ion trap may certainly become overfilled with respect to a good spectrum acquisition. However, since the isolation also functions satisfyingly if the ion trap is overfilled by more than 100 times, the overfilling is again alleviated. A slight overfilling is also harmless for fragmentation; it is much more important that the remaining daughter ions attain the optimal filling quantity.

The forecast value $f_0$ for the filling rate for a normal spectrum, with a slow change of concentrations, may be selected to be the same as that of the last mass spectrum. It is better, however, to extrapolate this value from several of the last scans, as described in U.S. Pat. No. 5,559,325. Here, for example, a linear extrapolation $f_{0.lin}$ may be selected from two spectra, a quadratic extrapolation $f_{0.qu}$ from three spectra, or a cubic extrapolation $f_{0.cub}$ from four spectra. Since an approximately exponential change prevails at the base of a chromatographic peak, a growth factor may also be derived here from the last two spectra, which then allows a calculation of the forecast value by extrapolation using this exponential growth factor.

From the integration over the ion current of the daughter ion spectrum and fron the known total filling time, the actual "filling rate" $f_{real}$ may be then determined. With this, the factor $a_p \times a_f$ from the yields may also be corrected for future daughter ion spectra (for example from the same chromatogram). For the second daughter ion spectrum, a forecast value for the filling rate $f_d$ may be assumed (with a slower change) which is equal to the measured filling rate $f_{real}$ from the first spectrum.

However, another method is better: After the first daughter ion spectra, a further normal spectrum is first inserted. From the normal spectra before and after the first daughter ion spectrum, a forecast value for the filling rate of the second daughter ion spectrum is then calculated as above, perhaps under consideration of the correction of the yields.

The filling of the third daughter ion spectrum may then, perhaps by inserting a further normal spectrum, be controlled from the filling rates of both daughter ion spectra already scanned. Normally, there would only be a linear extrapolation from two spectra, but here a more extensive trend (second and third differential coefficient) may also be taken into consideration through the known filling rates of the accompanying normal spectra.

Insertion of the normal spectra has a further advantage here: After completing the daughter ion scans, normal spectra with optimal control of filling may be continued immediately since their trend is known. In addition, the course of the chromatographic peak is very well known from the inserted normal spectra. In this way, the peak forms may be very well integrated for quantitative estimates.

Of course, the normal spectra need not be inserted uniformly. Sometimes it is practical to scan more daughter ion spectra than normal spectra. This is then the case, for example, if the aim is to obtain as large a dynamic range of measurement as possible for the daughter ion spectra by totalling all the individual spectra. Clarification of the structure of the molecule may also be well assisted by fragment ions which only appear very rarely, and these rare fragment ions may only be seen by a wide dynamic range of measurement.

When using addition to increase the dynamic range of measurement, the raw spectra must be added before any further evaluation, for only in this way does the signal-to-noise ratio, and therefore the dynamic range of measurement, increase accordingly. Usually, about 3 to 20 individual spectra are totalled to a "sum spectrum" by addition of all corresponding individual measurement values along the scan.

The parent ions may be isolated in the known manner already during ionization through continuing resonance ejection of undesirable ions by the use of exciting frequency mixtures with gaps. On the other hand however, as is also known, isolation methods may be applied after a controlled overfilling of the ion trap, since the isolation methods are still able to function even if the ion trap is overfilled by more than 100 times. The desired dynamic range of measurement is thus maintained in the spectrum even with subsequent isolation.

The method described here of filling control for the daughter ion spectra is especially advantageous because it saves measurement time. No time-consuming prescan is necessary for the control which must necessarily include the process of isolation and fragmentation for the daughter ion spectra. The prescan therefore takes longer than the scan of a normal spectrum, though it provides no further information than the value for the control.

The basic idea may be applied in a similar manner if granddaughter ion spectra are to be scanned. Spectra from isolated though nonfragmented ions may so be scanned accordingly, quite useful often for quantitative analytic work.

DESCRIPTION OF THE FIGURES

FIG. 1 shows the simple and fast calculation schematic for the linear, quadratic and cubic extrapolation of the filling rates from the measured filling rates $f_1$ to $f_4$ of the preceding spectra, if these—as usual—have the same scanning time intervals.

For daughter ions, it indicates the forecast value calculated using the yields.

The designations mean:

$f_{0.lin}$=forecast value of the filling rate for linear extrapolation $f_{0.qu}$=forecast value of the filling rate for quadratic extrapolation $f_{0.cu}$=forecast value of the filling rate for cubic extrapolation $f_d$=forecast value of the filling rate for daughter ions $f_0$=one of the forecast values $f_{0.lin}$, $f_{0.qu}$ or $f_{0.cu}$ $i_p$=integrated ion current of the parent ion peak $a_p$=isolation yield of the parent ions $a_f$=fragmentation yield of daughter ions $i_{tot}$=integrated ion current of the total spectrum

DESCRIPTION OF FAVORABLE EMBODIMENTS

One embodiment of the method according to this invention relates to the automatic scanning of daughter ion spectra of substances in chromatographic separation runs of unknown mixtures.

As an example for a detailed description, we consider the substance mixture of an enzymatic digest of an unknown protein into smaller peptides that is separated by liquid chromatography and measured mass spectrometrically in ion traps. The molecular weights of a few such peptides and the additional knowledge of some fragments of the amino acid sequence inside one or more peptides generally suffice to identify the protein clearly and with certainty using protein databases. In such protein databases, the sequences of the proteins are stored. For the task of protein identification, usually only a very minimal amount of protein is available; it is therefore important to scan the normal and daughter ion spectra in one single LC/MS analysis run.

For this task, liquid chromatography with electrospray ionization is used. Here, only normal mass spectra are scanned at first using the ion trap mass spectrometer. Electrospray ionization of smaller peptides which result from the enzymatic digestion, leads to ions which are charged about 2 to 5 times. The normal spectra sequentially scanned during the separation are now analyzed for the appearance of a first substance, e. g. by the search for peaks superceding a preselected threshold value. If a substance appears, a favorable parent ion is automatically selected for the scan of a daughter spectrum. In the simplest case, the most frequent ion in the spectrum is selected for this. However, for peptides, it is more favorable to look for the doubly charged molecule ion which may be recognized by the mass interval of the ions in the isotope group. The doubly charged ion generally one of the most frequent ions.

However, the doubly charge ion may also be found in another way. It is possible to analyze the normal spectrum in real time for the molecular weight of the ions in the substance, whereby the series of multiply protonized ions and their masses are used for a corresponding algorithm. The doubly protonized ions can be found immediately from the molecular weight.

The next step is the calculation of a suitable control value for the filling procedure of the ion trap for the first daughter spectrum to be scanned automatically. To do this, the last scanned normal spectra are used. From their known filling rates (the filling rate is the total ion quantity measured by integration of the ion current over the whole spectrum divided by the known filling time), a forecast value may be extrapolated for the filling rate $f_0$ of a further normal spectrum.

The control, in this case, best relies on a cubic extrapolation, since the signal in the chromatographic peak changes very drastically. The schematic of a cubic extrapolation is shown in FIG. 1. From the four filling rates $f_1$ (most recent normal spectrum) to $f_4$, the differences $a_1$ to $a_3$ are formed, from this the differences $b_1$ and $b_2$, and from this the difference $c_1$. The cubic extrapolation for the expected value $f_{0.cub}$ derives very easily from $f_0=f_{0.cub}=f_1+a_1+b_1+c_1$. This very simple calculation presumes that the temporal intervals for the scans are equal. For unequal spectral intervals, the extrapolation is somewhat more complex, although a specialist is acquainted with it.—The linear extrapolation works out analogously as $f_{0.lin}=f_1+a_1$; the quadratic extrapolation as $f_{0.cu}=f_1+a_1+b_1$.

However, the purpose is not to measure a normal spectrum, but rather a daughter ion spectrum from selected parent ions, i.e. of doubly charged molecule ions. These parent ions represent only a fraction of the ions of a normal spectrum, therefore the share $i_p/i_{tot}$ (the "relative abundance") of these parent ions in the total spectrum, which is known from the last normal spectrum, must first be calculated for later use.

The parent ions must then be isolated and fragmented. Ions are lost in this way. From the known yield $a_p$ for the isolation and the also known fragmentation yield $a_f$ of daughter ions, a forecast value for the filling rate $f_d$ for daughter ions can be calculated, according to equation (1). This value is generally quite correct and may used for controlling the filling. The isolation and fragmentation yields from the peptides are very constant from peptide to peptide and may therefore be determined rather well through calibration.

During storage of the ions, which are injected from the outside into the ion trap, isolation may take place in a known fashion using a frequency mixture applied to both end caps. The frequency mixture contains the oscillation frequencies of all ions which are not to remain in the ion trap. Their fundamental oscillations are excited by the frequencies in the direction of the trap axis, thereby increasing their oscillation amplitudes, and they leave the ion trap by colliding against the end caps and discharging, or by escaping through perforations. For those ions which are to remain in the ion trap, there are no excitation frequencies in the frequency mixture.

However, it is not necessary to perform the isolation during ion generation and storage. The ion trap may be filled with ions during ion generation until far beyond the optimal filling quantity for the scan and only then use the isolation. Several methods are known for this subsequent type of isolation. Since these methods of isolation also work just as well if the ion trap is overloaded by more than 100 times, the temporary overload of the filling-time control according to this invention can be intentionally controlled in such a way that, in this case, the optimal filling quantity in the ion trap occurs only after isolation and fragmentation of the desired ion species. The "filling rate" therefore includes, in this case, the process of initial overload and the subsequent isolation and fragmentation. Since the control of the filling quantity according to the invention relates to the integral ion quantities of the preceding spectra of the same generating type, it is not even necessary to know how great the overload actually is in a specific case.

After acquiring the daughter ion spectrum by one of several known scan methods, the actual "filling rate" with daughter ions is determined. If it does not agree with the calculated filling rate, a correction of the yield factors is calculated which may be used for subsequent daughter ion spectra.

Following the daughter ion spectrum of a first parent ion species, another normal spectrum is scanned before a daughter ion spectrum of a second parent ion species is measured. From this normal spectrum and its predecessors, as is known, a further forecast value for the filling rate of a normal spectrum is now derived from which the forecast value for the filling rate of the second daughter ion spectrum is obtained by correction using the yield factors. In this way, daughter ion spectra with optimal filling quantity may be obtained, although no daughter ions of this parent ion had been measured previously.

If the second daughter ion spectrum is to be taken from the same parent ion species, the forecast value for the filling rate of the second (or of a further) daughter ion spectrum may be calculated in another way. Here, it proceeds from the measured filling rate $f_{real}$ from the last daughter ion spectrum. From the accompanying normal spectra, a trend factor of the increase or decrease in the chromatographic peak is now calculated, which is produced, for example, as the quotient of the forecast value for a filling rate divided by the last current filling rate. This trend factor is then applied to the filling rate $f_{real}$ of the last daughter ion spectrum.

For this reason it may be practical, during the course of measurement, to continue to scan inserted normal spectra. The concentration measurements for the normal spectra are then uninterrupted. Also for more complex separation methods with incomplete separation of the chromatographic peaks, the course may thus be followed quite well. In particular, no substance peaks of a second substance are lost since the arrival of the first substance, and may still be observed when daughter ion spectra are being scanned for the first substance.

For the highest dynamic range in well separated chromatograms, it may however be better not to insert normal spectra between further daughter ion scans, but instead to use all measurement time for the scanning of daughter ions. The more daughter ion spectra are added to a sum spectrum, the higher the dynamic range of measurement in the totalled daughter ion spectrum.

The molecular weights of the peptides can now be determined from the normal spectra, and information about the sequence of amino acids in the individual peptides from the daughter ion spectra. Since the thread-like peptide ions usually carry their two charges on opposite ends, they frequently decay during fragmentation into two complementary singly charged ions, the mass sum of which must always equal the (doubly protonated) mass of the peptide. For this reason, the sequence information can be obtained relatively simply from this spectrum.

Once the molecular weights of the digested peptides and some sequences are known, the identity of the original protein can be determined immediately using an appropriately prepared database. Programs for this determination are readily available through internet.

However other applications are also possible with slightly changed embodiments. One of these applications relates to the so-called nanospray method which requires only extremely minimal amounts of substance, although it is generally operated by visual selection of the parent ions.

The nanospray method is an electrospray ionization which functions with a minuscule capillary. In the capillary, a quantity of only one to three microliters of solution is used in which there is about one picogram of a substance mixture. The nanospray ionization can be electrically switched on and off very quickly (U.S. Pat. No. 5,608,217) so that the substance is only consumed during filling of the ion trap.

After scanning a series of individual normal spectra, the sum spectrum can (with the nanospray ionization switched off, meaning without loss of substance) be visually evaluated. Here, (for example) one may use the mouse to click on a mass peak of the spectrum on the monitor and immediately receive a predetermined number of individual daughter ion spectra from the parent ions of the selected mass peak, which are added together to give a daughter ion sum spectrum. Here, the filling control may be calculated in a similar manner from the filling rate of the normal spectra as was described above. However, no linear or nonlinear extrapolation is required to do this, since the ion generation from the nanospray method is very constant; the filling rate can be assumed to be constant.

During visual evaluation of such a daughter ion sum spectrum, one may again click on a mass peak with daughter ions which are then isolated in another spectral series, fragmented and scanned in the form of granddaughter ion spectra. Here, another precalculation of the filling rate takes place according to the above pattern. The filling time for a single granddaughter ion individual spectrum may certainly be several seconds here. This method may be continued for great-granddaughters and great-great-granddaughters as required. This type of scan uses extremely low amounts of substance. Here, longer interruptions for consideration or discussion can take place without losing valuable sample substance.

The embodiments described here may certainly be transferred by a specialist to other analysis tasks of similar problematics.

We claim:

1. Method for the measurement of one or several spectra of isolated parent ions or of daughter ions from parent ions with a space-charge controlled ion trap mass spectrometer, out of a series of measurements of normal spectra, comprising the steps of:

1) acquiring a series of normal spectra,
2) investigating the spectra for signals of substances of interest,
3) if a substance of interest is found, selecting a species of parent ions of this substance as a basis for the measurement of a spectrum of the isolated parent ion or of daughter ions thereof,
4) determining the relative abundance of the parent ions with respect to all ions in the spectrum, and
5) measuring the spectrum of the isolated ions or daughter ions, wherein the control of the space charge present at the begin of the spectrum acquisition relies on a forecast value of the filling rate of previously acquired normal spectra, on the relative abundance of the parent ions in the normal spectra, on predetermined yield factors of isolation and fragmentation, and, if available, on the filling rate of isolated ion spectra or daughter ion spectra taken previously.

2. Method according to claim 1 for the measurement of a first daughter ion spectrum out of a series of normal spectra, wherein (in the step 5) the control of the space charge present at the begin of the spectrum acquisition solely relies on a forecast value of the filling rate of previously acquired normal spectra, on the relative abundance of the parent ions in the normal spectra, and on the predetermined yield factors of isolation and fragmentation.

3. Method according to claim 1, wherein a series of daughter ion spectra is regarded as the series of normal spectra, and the measurement goal is directed towards the measurement of a granddaughter ion spectrum.

4. Method according to claim 1, wherein the forecast filling rate for a normal spectrum as a basis for the calculation of the filling rates for isolated or daughter ions is assumed to be identical with the last measured filling rate of the previous normal spectrum.

5. Method according to claim 1, wherein the forecast filling rate for a normal spectrum as a basis for the calculation of the filling rates for isolated or daughter ions is calculated from the measured filling rates of the previously measured normal spectra by linear, quadratic, cubic or exponential extrapolation.

6. Method according to claim 5, wherein a correction factor is determined of an previously measured isolated or daughter ion spectrum by comparison of the calculated filling rate with the truly measured filling rate, and is used for subsequent scans of spectra for improvement of the filling control.

7. Method according to claim 1, wherein the forecast value for the filling rate for isolated or daughter ions is determined from the filling rates of at least one of the previously measured spectra of the same ion generation and manipulation conditions, whereby the trend of the concentration changes of the substance is derived from the evaluation of the accompanying normal spectra.

8. Method according to claim 1, wherein several individual spectra of each ion species are added separately to give a sum spectrum and only the sum spectra are evaluated quantitatively.

9. Method for the automated measurement of the first spectrum of isolated parent ions or of daughter ions from parent ions with a space-charge controlled ion trap mass spectrometer, out of a series of measurements of normal spectra, comprising the steps of:

1) acquiring a normal spectrum out of the series of spectra,
2) automatically investigating, by on-line computer evaluation and using a preselected rule, the spectra for signals of substances of interest,
3) if a substance of interest is found, automatically selecting a species of parent ions of this substance as a basis for the first measurement of a spectrum of the isolated parent ion or of daughter ions thereof, according to a preselected rule, else returning to step 1,
4) automatically determining the relative abundance of the selected parent ion species with respect to all ions in the spectrum, and 5) automatically measuring the first spectrum of the isolated ions or daughter ions, wherein the control of the space charge present at the beginning of the spectrum acquisition relies on a forecast value derived from filling rate(s) of previously acquired normal spectra, on the relative abundance of the selected parent ions in the normal spectra, and on predetermined yield factors of isolation and fragmentation.

* * * * *